United States Patent [19]

Spector et al.

[11] 4,016,783

[45] Apr. 12, 1977

[54] VALVE WRENCH

[76] Inventors: George Spector, 233 Broadway, Rm. 3615; Sergio Casino, c/o George Spector, 233 Broadway, Rm. 3615, both of New York, N.Y. 10007

[22] Filed: Aug. 25, 1975

[21] Appl. No.: 602,666

[52] U.S. Cl. ..... 81/71; 81/125

[51] Int. Cl.[2] ..... B25B 13/48

[58] Field of Search ..... 81/3 R, 71, 90 R, 90 C, 81/121 R, 121 A, 121 B, 125

[56] References Cited

UNITED STATES PATENTS

| | | | |
|---|---|---|---|
| 2,488,036 | 11/1949 | Pofcher | 81/71 X |
| 2,574,352 | 11/1951 | Senter | 81/125 |
| 2,643,566 | 6/1953 | Santos et al. | 81/121 R X |
| 2,649,825 | 8/1953 | Fisher | 81/125 |
| 3,379,078 | 4/1968 | Sallows | 81/125 |

*Primary Examiner*—Al Lawrence Smith
*Assistant Examiner*—James G. Smith

[57] ABSTRACT

An improved wrench designed particularly for screwing a polished angle valve or other plumbing fitting without leaving unsightly teeth marks on it; the wrench including a hollow housing at one end of a crank handle, the housing being placed around the valve or other fitting, and the housing also supporting a rotatable transverse extending stabilizer bolt that threadingly engages the threaded end of the valve so to firmly hold the same while it is being screwed.

6 Claims, 11 Drawing Figures

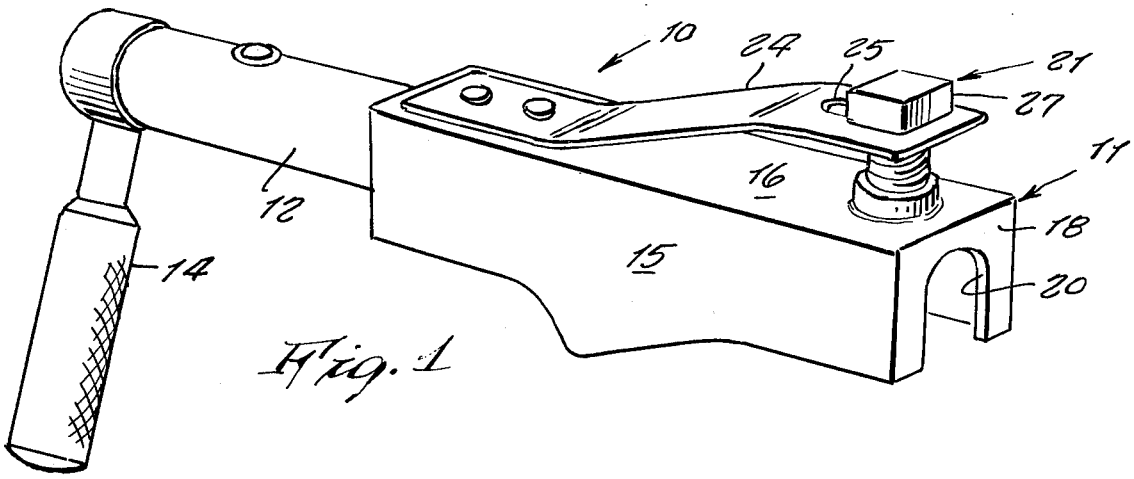
Fig. 1
Fig. 2
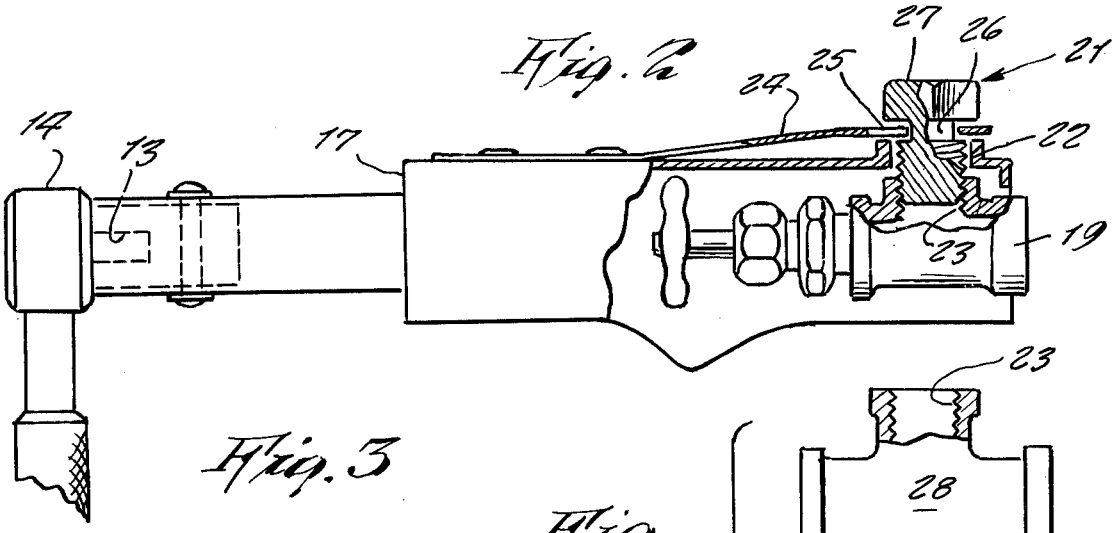
Fig. 3
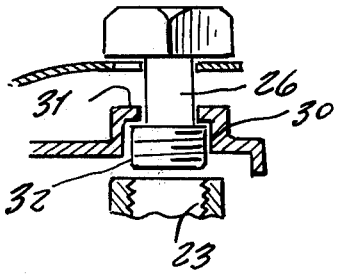
Fig. 4
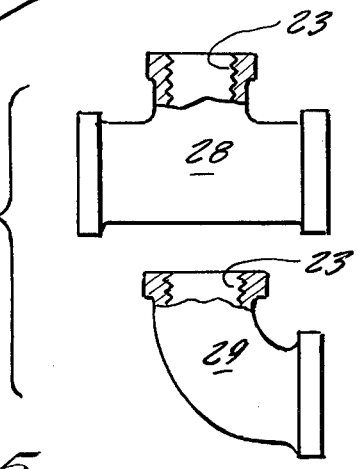
Fig. 5
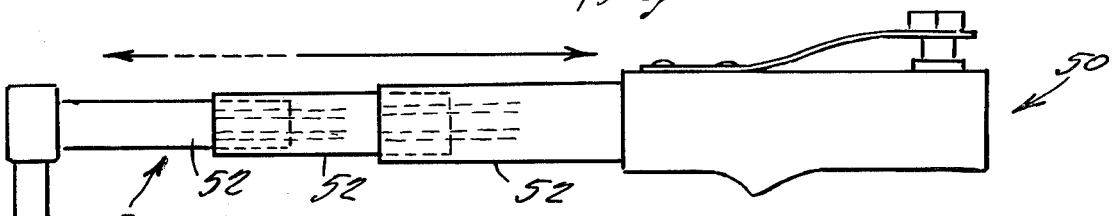
Fig. 7
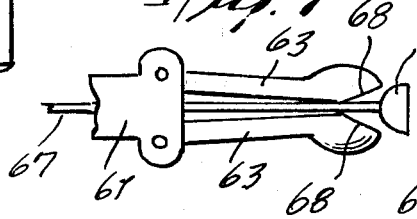
Fig. 6
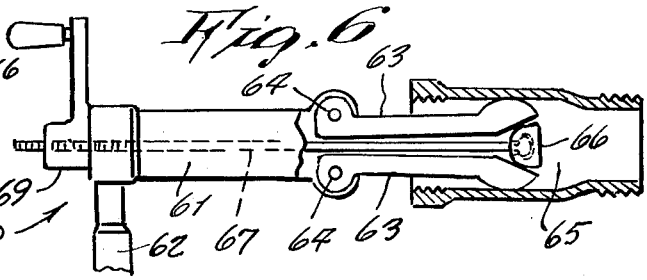

VALVE WRENCH

This invention relates generally to pipe wrenches.

It is generally well known that a great many of plumbing fittings such as a pipe, tees, elbows and angle valves are made chrome plated particularly if they are to be installed where they are exposed to view such as in a shower room, bathroom and the like, so it is desirable that the finish of such fittings are not scratched nor injured when they are being installed. A conventional pipe wrench, as well as all other known types of wrenches leave unsightly teeth marks on objects that they firmly grasp, so that this situation is in want of an improvement.

Accordingly, it is a principal object of the present invention to provide an improved valve wrench for various different polished fittings such as tees, elbows and angle valves, and which does not grasp the fitting around its polished outer side when screwing the same firmly with other objects, so it does not injure the same.

Another object is to provide a valve wrench which replaces the use of a basin wrench, pipe wrench, parmalee wrench and chain wrench in grasping such polished fittings.

Yet a further object is to provide a valve wrench which holds the fitting more firmly than any jaw type wrench, so that the fitting cannot be accidently loosened and dropped so that an installation job is quicker to accomplish and safer against injury of a worker's hands.

Other objects are to provide a valve wrench which is simple in design, inexpensive to manufacture, rugged in construction, easy to use and efficient in operation.

These and other objects will be readily evident upon a study of the following specification and the accompanying drawing wherein:

FIG. 1 is a perspective view of the invention.

FIG. 2 is a side view partly in cross section, and shown in use.

FIG. 3 is a modified design of structure shown in FIG. 2.

FIG. 4 is a view of other fittings adaptable to be turned by the present invention.

FIG. 5 is a side view of a telescopic design of the invention.

FIG. 6 is a side view of a modified design of the invention that is adaptable to screw straight pipe without grasping the outer side thereof so to not scratch a chrome polished finish.

FIG. 7 is a view similar to FIG. 6 and showing the tool in a collapsed position.

Figure 8:
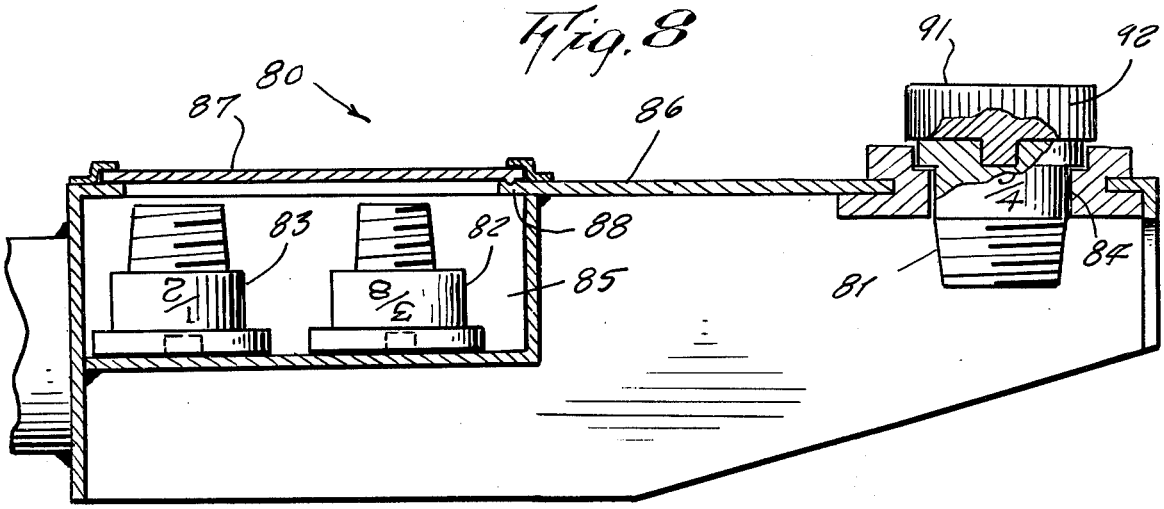
FIG. 8 is a side cross sectional view of another modified design wherein the stabilizer bolt is interchangable with stabilizer bolts of other sizes, and which can be stored in a compartment provided on the wrench.
Figure 9:
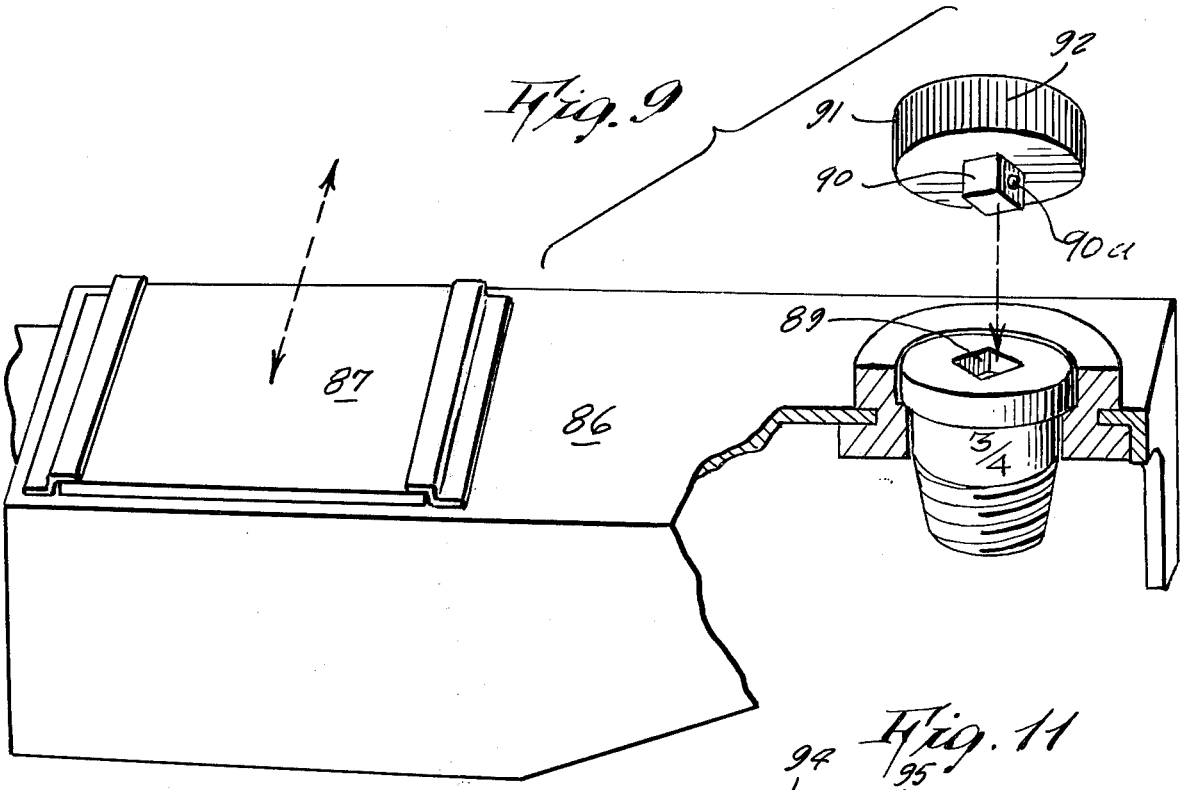
FIG. 9 is a perspective view thereof and showing a removable stabilizer knob for turning the stabilizer bolt.

Referring now to the drawing in detail, and more particularly to FIGS. 1 through 4 thereof at this time, the reference numeral 10 represents a valve wrench according to the present invention wherein the same includes a hollow housing 11 integral with one end of a handle 12 which at its other end has a square socket 13 for being engaged by a socket wrench 14 extending at right angle to an axis of the handle 12 so that together they serve as a crank handle to turn the tool.

The housing 11 includes opposite side walls 15, top wall 16, rear wall 17 and a front wall 18. An underside of the housing is left open so that a plumbing fitting such as an angle valve 19 can be received therewithin. A notched opening 20 on the front wall 18 allows that valve to protrude outwardly therefrom so to be screwed to other plumbing fittings during an installation, or else removed therefrom during a disassembly thereof.

The valve 19 is held by the valve wrench 10 in a position so that the arcs of the valve aligns with the longitudinal central axis of the wrench, as shown in FIG. 2. The valve is held in this position by a stabilizer bolt 21 extending through a clearance opening 22 on the housing top wall 16; the bolt being along an axis that is perpendicular to the longitudinal axis of the tool so to threadingly engage a threaded opening 23 on the side of the angle valve The stabilizer screw is retained from separation and loss from the wrench by means of a leaf spring 24 secured at one end to the housing and which at its other end has a clearance slot 25 that fits around unthreaded portion 26 of the bolt shank. The portion 26 is of narrower diameter than the threaded end of the bolt and the head 27 thereof so that the slot 25 is correspondingly narrow thereby retaining the bolt from loss while still being free to rotate.

In use, the stabilizer bolt is tightened to the valve or other fitting so that rotation of the tool screws the valve on or off a plumbing installation. It will be noted that the wrench does not in any way grasp a polished outer side of the valve during this operation, so it cannot injure the same. In like manner, the tool can engage threaded openings 23 of either a tee 28 or elbow 29.

In FIG. 3, a modified design 30 of the above described opening 22 of the housing also includes an inwardly extending flange 31 so to form a shoulder on an underside thereof against which the diametrically enlarged threaded portion 32 of the bolt abuts so to prevent removal of the bolt from the opening 30 so it cannot become misplaced.

In FIG. 5, a modified design of valve wrench 50 is shown that includes a telescopic handle 51 made of slidably interfitted handle sections 52 that slide axially respective to each other but are splined so to be held rotationally together.

In FIGS. 6 and 7, another modified design of valve wrench 60 is designed to grasp fittings such as do not have a sidewardly extending threaded opening so to be grasped thereby, and which accordingly would be suitable for grasping straight pipe and the like, and which are grasped without the benefit of a thread engagement therebetween.

The wrench 60 includes a shank 61 integral with handle 62 at right angle thereto for leverage purposes. A forward end of the shank pivotally supports a pair of arms 63 on pivot pins 64, the arm outer ends being rounded and possibly knurlled so to be positioned against an inner surface 65 of a fitting intended to be held thereupon. A wedge 66 retained on an end of a shaft 67 is axially movable between angularly sloped faces 68 of the arm ends so to force the arms apart and bind hard against surface 65. The shaft extends outwardly through the end of the shank and handle 62, and is threaded so to be secured in a threaded opening of a an extended leverage handle 69 which when rotated, advances the wedge to lock the arms to the inner side of the fitting so that its outer side is not scratched or defaced by the tool.

In FIGS. 8 to 11 another design of valve wrench 80 differs from wrench 10 by having several different sizes of stabilizer bolts 81, 82 and 83 which are removable from an opening 84 on the housing top wall, so to be interchangable, and which when not in use are stored in a container 85 formed inside the housing 86, and being removable therefrom by sliding off a cover 87 that covers the container and is held from accidentally sliding off therefrom by a detent 88.

The bolts 81, 82 and 83, are each provided with a square socket 89 upon a head end of the bolt for being engaged by square projection 90 of a stabilizer nut 91 of larger diameter and having knurl 92 so that it can be comfortably held and permits applying a greater torque force on the bolt so to tighten the same to a fitting. The removable knob also permits all bolts to be made of smaller size so that a large number thereof fit together with the knob inside the container 85. Projection 90 has a ball detent 90*a*.

Figure 10:
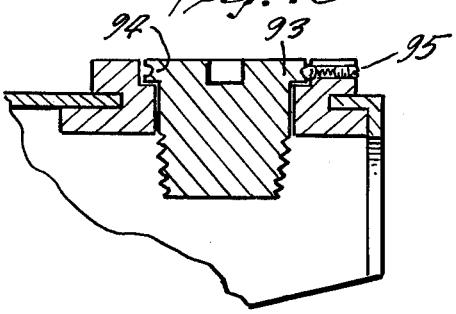
FIG. 10 is a cross sectional view of a further modified design wherein the stabilizer bolt snap engages with a detent on the tool so that it does not accidently fall off when not in use.
Figure 11:
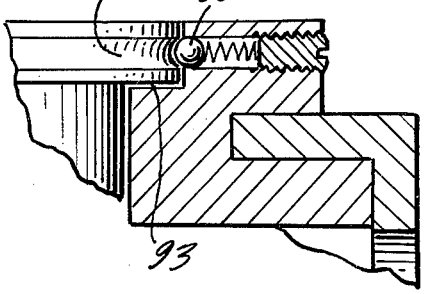
FIG. 11 is an enlarged detail view thereof shown also in cross section.

In FIGS. 10 and 11 a slightly modified design of the wrench 80 shows the bolt head 93 having an annular groove 94 for snap fitting with a ball of a detent 95 so to prevent the bolt to accidently fall off the wrench when the bolt is not holding a fitting.

Thus several different designs of the invention are presented.

While various changes may be made in the detail construction, it is understood that such changes will be within the spirit and scope of the present invention as is defined by the appended claims.

What is claimed is:

1. In a valve wrench, the combination of a housing integral with one end of a handle, said handle attached at its other end to a sidewardly extending socket wrench, said housing having an opening on an underside thereof for receiving a fitting, a forward end of said housing having an opening so said fitting protrudes outwardly therefrom, and a stabilizer bolt extending through a top wall of said housing for engaging a threaded opening along a side of said fitting.

2. The combination as set forth in claim 1 wherein said bolt is retained rotatably free in a slot of a leaf spring secured to said housing.

3. The combination as set forth in claim 1 wherein said bolt extends through an opening of said housing top wall, said opening having an inward flange around a center narrow diameter portion of said bolt.

4. The combination as set forth in claim 1 wherein said housing includes a storage chamber containing interchangable like said bolts which are of different sizes.

5. The combination as set forth in claim 4 wherein said bolts each includes an annular groove around a head thereof removably engaged by a detent carried by said housing top wall.

6. The combination as set forth in claim 5 wherein said bolts each have a square socket on an end of a head thereof, said socket being removably engaged by a square projection of a knurlled stabilizer knob of enlarged diameter.

* * * * *